United States Patent [19]

Blotenberg

[11] Patent Number: 4,944,652

[45] Date of Patent: Jul. 31, 1990

[54] PROCESS AND DEVICE FOR THE CONTROL OF TURBO COMPRESSORS

[75] Inventor: Wilfried Blotenberg, DinsLaken, Fed. Rep. of Germany

[73] Assignee: MAN Gutehoffnungshütte GmbH, Oberhausen, Fed. Rep. of Germany

[21] Appl. No.: 312,638

[22] Filed: Feb. 17, 1989

[30] Foreign Application Priority Data

Feb. 18, 1988 [DE] Fed. Rep. of Germany ..... 3805119

[51] Int. Cl.[5] ..... F04D 27/02

[52] U.S. Cl. ..... 415/27; 415/1

[58] Field of Search ..... 415/1, 17, 26, 27, 28

[56] References Cited

U.S. PATENT DOCUMENTS

| | | | |
|---|---|---|---|
| 4,139,328 | 2/1979 | Kuper et al. | 415/1 |
| 4,789,298 | 12/1988 | Blotenberg | 415/27 |
| 4,810,163 | 3/1989 | Blotenberg | 415/27 |
| 4,831,534 | 5/1989 | Blotenberg | 415/1 |

*Primary Examiner*—Edward K. Look
*Assistant Examiner*—John T. Kwon
*Attorney, Agent, or Firm*—McGlew & Tuttle

[57] ABSTRACT

In the surge limit control for turbo compressors the amplification factor of the control device producing the control signal for a blow-off valve is varied according to the ascending gradient of the compressor's characteristic corresponding to the respective working point.

7 Claims, 3 Drawing Sheets

PROCESS AND DEVICE FOR THE CONTROL OF TURBO COMPRESSORS

FIELD AND BACKGROUND OF THE INVENTION

The invention relates to a process for the control of turbo compressors with regard to the avoidance of surging and to a device for the execution of this process.

In compressors, surging is the pulsating or periodical reflux of a pumping medium from the delivery side to the suction side. This situation arises e.g. when the delivery pressure or the delivery pressure to suction pressure ratio is too high and/or the volume rate of flow is too low. Therefore, a surge limit line can be defined univocally in the performance graph (a graph of the relationship of turbo compressor parameters) which divides the performance graph into a stable and an instable section. As a rule, the surge limit line is curved, i.e. its ascending gradient changes within the performance graph. In a frequently used characteristics diagram, wherein the coordinates are volume rate of flow and pressure, e.g., the surge limit curve flattens as the pressure increases. For other performance graphs featuring guide blade position, rpm, head of the compressor etc. the same applies.

In order to prevent compressors from surging, a blow-off curve, or anti-surge control curve, may be defined on the performance graph at a safety distance from and parallel to the surge limit curve. When the actual working point approaches the blow-off curve, a blow-off valve or by-pass valve is opened to a small extent or a great extent depending upon the system. Due to this the actual value of a controlled variable, in particular the value of the volume rate of flow, does not surmount the set value determined by the blow-off curve and the command variable, in particular the delivery pressure. The anti-surge control can be considered a flow control with a variable flow set point, which is determined from the actual measured compressor discharge pressure (or pressure ratio if this is plotted on the vertical axis). The anti-surge controller output is changed to such an extent that the flow to the process plus the flow through the blow-off or by-pass valve is identical to the flow at the blow-off line at the respective actual discharge pressure. If process flow decreases, controller output changes to open the blow-off valve, so that the set point value, i.e. flow at the blow-off line, and the actual value match. If the blow-off curve has a constant gradient, the relationship between pressure changes and set point changes is constant. If the blow-off curve has a gradient which is not ccnstant, the set point changes are small where the blow-off curve is steep, and the set point changes are large where the blow-off curve gradient is less steep. Therefore, the gain or amplification of the system is not constant.

There are also automatic controls wherein the volume rate of flow serves as the command variable for the determination of the set value and wherein the delivery pressure is the controlled variable to be adjusted with regard to the set value.

The curved course of the blow-off curve results in a preset change of the command variable, or controller output, (e.g. discharge pressure) at various points on the blow-off curve which results in changes in the set value for the controlled variable. This results in variations in the control loop amplifications.

Anti-surge limit control means are safety control means and are normally activated to work near the stability limit in order to guarantee the best compressor protection possible. The stability limit is the limit where the closed control loop becomes unstable due to a too-high closed loop gain or amplification. The position of the stability limit is heavily influenced by the overall amplification of the control loop. A high degree of overall amplification is most likely to lead to instability cf the system. However, to get the best control results, the gain should be selected as high as possible. The higher the gain, the better the control result.

In order to achieve the most constant overall amplification possible, it is suggested in compliance with the EP-A-O 223 208 (see also U.S. Pat. No. 4,789,298) to compensate the influence of the valving line on the amplification factor by taking into account the ascending gradient of the valving line in various characteristic sections. However, it has turned out that a constant overall amplification can be achieved only within limits as the non-linear gradient cf the compressor's characteristic curve also creates a change in the sectional amplification and thus influences the overall amplification.

SUMMARY AND OBJECTS OF THE INVENTION

Accordingly, the object of the invention is to provide a process and a means for its execution, wherein an optimal adaptation of the reaction of the control device to the various sections of the performance graph and operational states of the compressor is possible.

The invention provides a system and device for balancing the effects of the descending gradient of the compressor's characteristic, which changes with the command variable on the overall control loop amplification, and a respective change of the amplification factor in opposite direction. (The command variable is the value on the vertical axis of the performance graph). This results in an overall amplification independent of the course of the characteristic. This basic principle can also be realized approximately by switching between two or more different values of the amplification factor of the control means.

According to the invention, a method and apparatus is provided for controlling a turbocompressor to avoid surging of the turbocompressor. A system is employed which continuously measures the actual value of a command variable, such as pressure, and the value of a controlled variable, such as volumetric rate of flow. The command variable and the controlled variable define the position of the turbocompressor working point forming a characteristic curve plotted in a turbocompressor performance graph. A blow-off curve is also plotted in the turbocompressor performance graph which is used for controlling a blow-off valve. A set value for the controlled variable is determined by selecting a set value for the controlled variable corresponding to the measured actual value of the command variable along the blow-off curve in the performance graph. A correction signal is generated by comparing the measured actual value of the controlled variable and the determined set value of the controlled variable. The amplification factor of the control device is changed depending upon the actual value of the command variable. The amplification factor is then changed in dependence on the descending gradient of the turbccompressor characteristic curve based on the measured actual value of the working point so as to attenuate influences of the descending gradient of the turbocompressor characteristic curve on the control system amplification.

It is an object of the invention to provide a turbocompressor with a method and apparatus for compensating for the influence of a bent, or curved blow-off line and characteristic curve in order to get a constant closed loop gain in the entire operating range of the compressor.

The various features of novelty which characterize the invention are pointed out with particularity in the claims annexed to and forming a part of this disclosure. For a better understanding of the invention, its operating advantages and specific objects obtained by its uses, reference is made to the accompanying drawings and descriptive matter in which preferred embodiments of the invention are illustrated.

DESCRIPTION OF THE PREFERRED EMBODIMENTS

Figure 1:
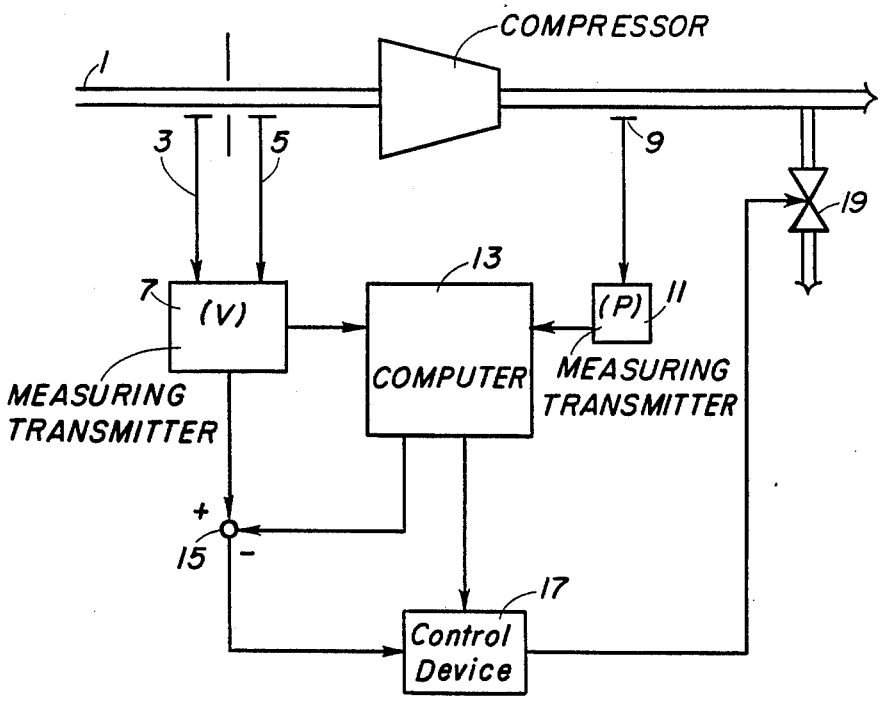
FIG. 1 is a simplified diagram of a system for the control of a turbo compressor to avoid surging.

According to FIG. 1 the pressure is sensed by sensors 3, 5 in front of and behind a throttle in the compressor intake 1. A measuring transmitter 7 forms the actual value for the compressor volumetric rate of flow V on the suction side. On the compressor delivery side a sensor 9 measures the actual value of the delivery pressure P, which is fed into a computer 13 by a measuring transmitter 11. The computer 13 has a memory which contains the course of the valving line or blow-off curve A in the compressor performance graph defined by P and V. The computer 13 calculates the set value for the volumetric rate of flow V from the actual value P and the blow-off line. The actual value and the set value of the volumetric rate of flow are compared in a comparator or differential element 15 and the calculated difference is fed as an input signal into a control device 17 with proportional-integral-and/or differential behavior. The output signal of the control device 17 is used as a command variable for a blow-off valve 19 branching from the compressor delivery side venting to the atmosphere or is advantageously a by-pass valve leading back to the suction side of the compressor.

Figure 2:
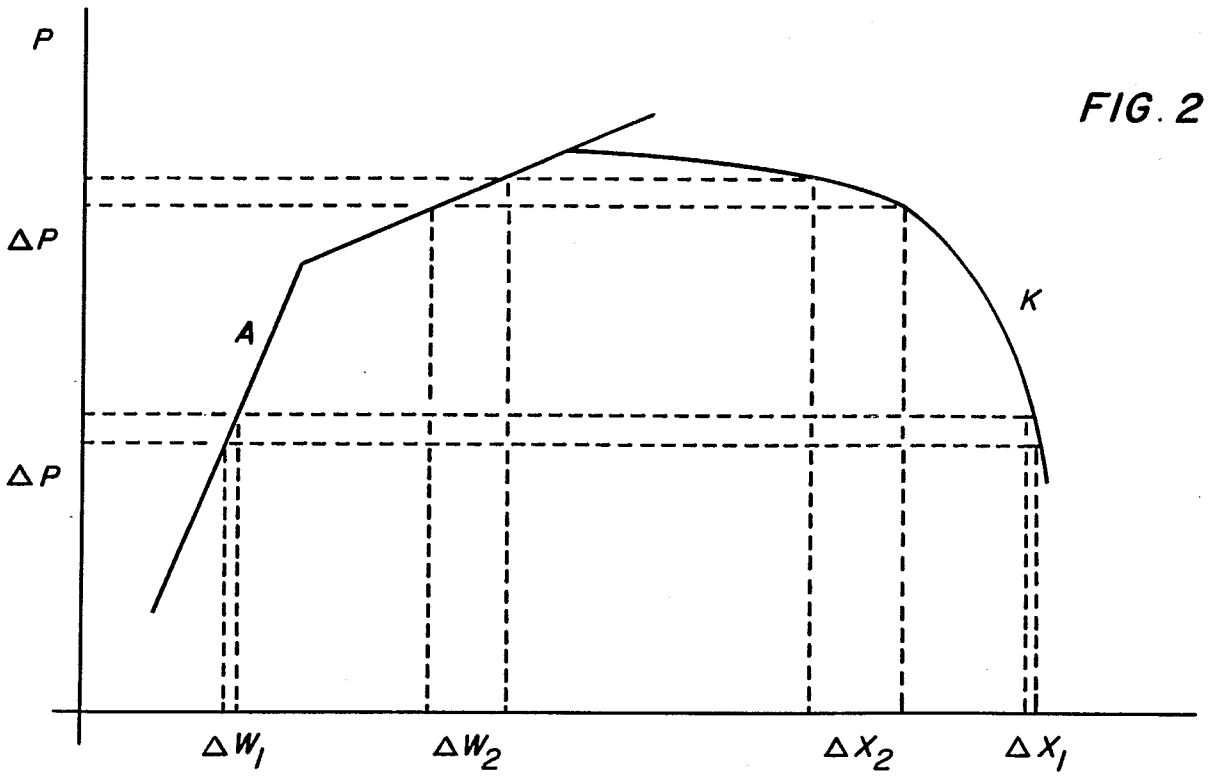
FIG. 2 shows a diagram of the courses of a valving line A and a characteristic line K in the performance graph.

In the compressor performance graph formed by the volumetric rate of flow V as the abscissa and the delivery pressure P (or the delivery pressure—suction pressure ratio) as the ordinate, both the blow-off line, or curve A and the compressor characteristic line or curve K are curved, as shown in FIG. 2. Therefore a specific change $\Delta P$ of the delivery pressure serving as the command variable results in changes of different magnitudes $\Delta X_1$ and $\Delta X_2$ of the actual value and $\Delta W_1$ and $\Delta W_2$ of the set value for the volumetric rate of flow. The variances will result in changes in the overall amplification of the control loop if the control device 17 shows a constant amplifier factor or gain. The steep bottom section of the course of the curves in FIG. 2 corresponds to a small amplification and the flattened upper section of the course corresponds to a large amplification.

However, as an alternative the tasks of the command variable and the controlled variable are advantageously switched, i.e. the volumetric rate of flow V is used as command variable and for the set value the delivery pressure P is used. The relationship is thereby switched, and the amplification is large in the steep section and small in the shallow section.

The overall amplification of the control loop is the sum of the amplification resulting from the ascending gradient of the blow-off curve and the amplification factor of the control device 17 plus the so-called control gain of the system, i.e. the amplification factors given by the controlled system, particularly by the compressor and the blow-off valve. According to the invention, the amplification factor in the control device 17 is changed as a function of the characteristic of the compressor and, if necessary, of the course of the blow-off curve in order to compensate for the influence of the compressor on the amplification.

In a given change of the pressure the variance $X_d$ supplying the difference between the actual value and the set value is as follows:

$$\Delta X_d = \Delta W - \Delta X$$

With low pressure the variance hardly changes at all and the value $\Delta X_d/\Delta P$ is small. In the upper section, however, this value is much higher, thus the control device reacts much stronger to a pressure change by the rate of $\Delta P$ in the upper performance graph section than in the bottom section.

The gain of the closed control loop depends on the gain provided by the system controller and on the gain of the compressor with the pipe work system. The gain of the closed control loop should be constant over the entire operating range of the compressor. Because the gain of the compressor is non-linear, the gain of the loop is non-linear. With the introduction of a compensation factor, this non-linearity can be compensated for.

This means that the "control gain of the system" which depends on the course of the turbo compressor or characteristic K and of the blow-off curve A is not linear. The total amplification factor $V_R$ can be represented as the product of the proportional gain or amplification KP and the amplification component depending on the characteristic $V_K$:

$$V_R = V_K \times kP.$$

By introducing $V_{comp}$ compensation term a constant overall amplification can be achieved by choosing $V_{comp} = 1V_K$.

Often, the shape of the compressor performance curve, as shown in FIG. 2, can be defined by the function:

$$X = F(P + g(Y_L)) - K_2 g(Y_L):$$

Where X is the horizontal axis and $Y_L$ is the guide vane position, K = constant, f and g are non-linear functions. This means that the gain factors change, which depends on the shape of the curve and can be shown as:

$$K(P) = f(P + g(Y_L)) - K_2 \times g(Y_L)$$

If the blow-off curve is called A (P), a pressure change of 2 P results in a pressure-dependent compensation factor of $$\frac{1}{V_{comp}} = \frac{A(P+\Delta p) - A(P-\Delta p)}{2\,\Delta p} - \frac{f(P+\Delta p+g(Y_L)) - f(P-\Delta p+g(Y_L))}{2\,\Delta p}$$

Here the first term corresponds to the reciprocal ascending gradient of the blow-off curve and the second term corresponds to the reciprocal ascending gradient of the compressor's characteristic for the transition $\Delta p \rightarrow 0$. There is only one blow-off curve. Therefore, it is very easy to store the reciprocal shape of a blow-off line.

The first term can be stored as a whole as h (P) in a function generator. The second term cannot be stored as a single function as the first term because there are many compressor performance curves for different guide vane positions.

Figure 3:
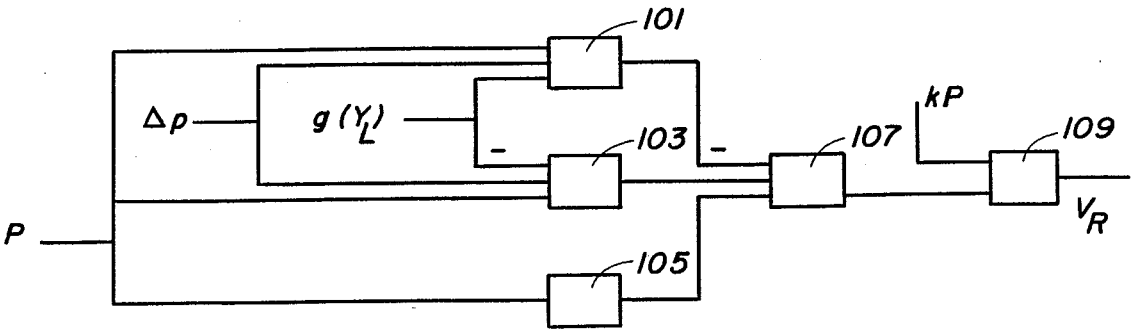
FIG. 3 shows a detail of the control means in a first embodiment.

FIG. 3 shows the structure of an embodiment for the realization of a control loop with constant overall amplification. The original values P, ΔP and $g(Y_L)$) form the value for f (P+Δp+g(Y:)) in the operational unit 101. They form the value f (P−p+g(Yr)) in the operational unit 103, and form value h (P) in the operational unit 105. The received values are then added or subtracted in the addition unit 107, thereby arriving at the compensation factor $V_{comp}$. Then the preset proportional amplification kP in the division unit 109 is divided by this compensation value, so that there is a constant overall amplification $V_R$ at the exit of unit 109. Then the overall amplification $V_R$ is fed into the control means 17 in FIG. 1. The above process can also be executed so that instead of the secant formation, i.e. of the difference formation, the respective reciprocal values of the ascending gradients of different compressor performance curves can be fed into the respective function generator immediately. Each performance curve being for constant guide vane position. The output signals of the function generators are handled respectively.

Figure 4:
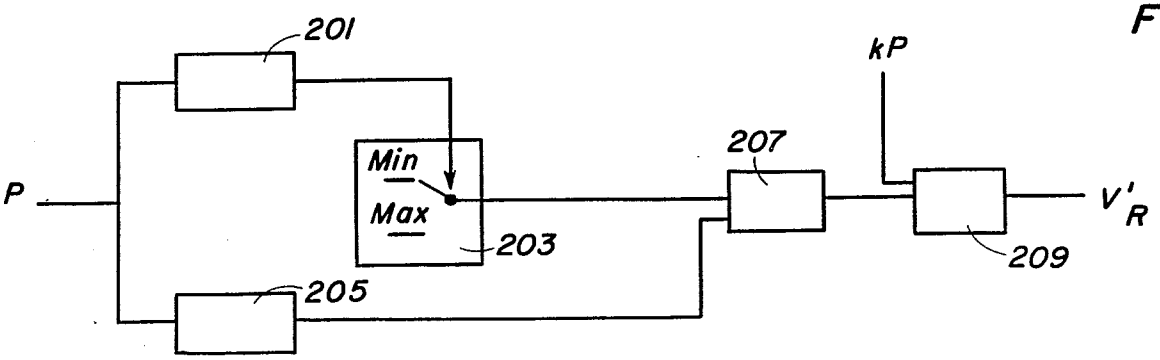
FIG. 4 is a detailed diagram of the control system according to another embodiment of the invention.

In the simplified embodiment in FIG. 4 instead of representing the exact course of the compressor characteristic curve, this curve is approximated by straight lines, and the resulting discrete descending gradient values of the straight lines are used for the determination of the compensation value. FIG. 4 shows a diagram for the determination of the discrete values. Herein the input signal P is fed into a comparator 201, which compares whether the input value lies above or below a threshold. The comparator controls a change-over switch 203, which passes the respective discrete ascending minimum and maximum gradient values on to the substraction element 207. The substraction element 207 is fed the value h (P) by the function generator 205, and the output signal serves as a divisor for the proportional amplification KP in the division element 209, so that a respective output signal $V'_R$ for the overall amplification is achieved.

In a further simplification the function of unit 205 can also be given to the comparator, so that 207 is no longer necessary either.

Instead of a change-over between two discrete values, the change-over switch 203 can be laid out for switching between a multitude of discrete values. This corresponds to an adjustment of the characteristic through several straight line sections.

A different solution for controlling the system by means of a comparator and a change-over switch would be to appoint these functions to a function generator. In addition, the value h(p) can be formed in the function generator so that the function of units 201, 203, 205 and 207 of FIG. 4 are performed in one unit. In this case the calculation of the aforementioned formulas takes place during the initial operation of the system (start-up) and the function generator delivers a sequence of values fed in advance for $V'_R$ as a function of P.

In normal control algorithms an abrupt change-over leads to an abrupt change of the controller output. To avoid this, it is advantageous in the present invention to use a recursive control algorithm. Herein the present correcting variable y(t) is not only dependent on the amplification $V'_R$ and the momentary variance $x_d$ (t), but also from the variance $x_d$ and the controlling variable y at the point of time $(t-T_S)$ in a previous scanning, i.e. a point of time earlier by the sampling point $T_S$ of the control device.

Control can e.g. be effected according to the following control algorithm, wherein $T_N$ is the reset time of the control device:

$$y(t) = y(t-T_S) + V_R\left[x_d(t) - x_d(t-T_S) + \frac{T_S}{T_N}x_d(t)\right]$$

By means of this kind of control, which takes into account former values of the variance and of the correcting value, jerky changes in the correcting value can be avoided.

The field of application of the invention is not limited to the performance graph presentation used in this example, but it can also be employed in other representations, i.e. in pressure ratio to intake volume flow, rpm to volume flow guide blade position to volume flow or a combination of the above representations.

While specific embodiments of the invention have been shown and described in detail to illustrate the application of the principles of the invention, it will be understood that the invention may be embodied otherwise without departing from such principles.

What is claimed is:

1. A method for controlling a turbocompressor to avoid turbocompressor surge comprising the steps of: determining a characteristic curve including non-linear characteristics of the turbocompressor based on two turbocompressor variables, such as discharge pressure and volumetric rate of flow; forming a blow-off line based on the same two turbocompressor variables, such as discharge pressure and volumetric rate of flow; during operation, continuously measuring one of the two variables as a controlled variable, such as volumetric rate of flow and continuously measuring the other variable as the command variable, such as discharge pressure, the measured command variable and measured controlled variable defining the position of the turbocompressor working point with respect to the characteristic curve and the blow-off curve; determining a set value of the controlled variable on the blow-off curve corresponding to the measured command variable; generating a controller output for operating a blow-off valve based on the difference between the measured value and the set value of the controlled variable; and, changing the gain of the turbocompressor control depending upon the nonlinear characteristics of the turbocompressor characteristic curve at the working point so that the influence of the gradient nonlinear characteristics of the turbocompressor characteristic curve on the overall gain on the control loop is substantially compensated.

2. A method according to claim 1, wherein the gain is changed depending on both the gradient of the compressor's characteristic curve at the working point and also the gradient of the blow-off valve at the working point.

3. A method according to claim 1, wherein: the gain of the control device is compensated by a factor which is reciprocally proportional to the value of the gradient of the compressor's characteristic curve at the measured value of the command variable.

4. A method according to claim 1, wherein: the gradient of the compressor's characteristic curve is approximated by straight line sections each having a different gradient corresponding to a value of the command variable, the gain being changed in dependence upon the gradient of the straight line section corresponding to the measured command variable.

5. A system for controlling a turbocompressor to avoid turbocompressor surge comprising: a first sensor to detect a turbocompressor variable to be used as a command variable; at least a second sensor to sense a second turbocompressor variable to be used as a controlled variable; function means for outputting preset parameters of a blow-off curve and for receiving the measured command variable and outputting a set controlled variable corresponding to the measured command variable based on the preset parameters for the blow-off curve; comparator means for receiving the actual value of the controlled variable and the set value of the controlled variable and outputting a signal representative of the difference between the measured controlled variable and set value of the controlled variable; control means for receiving the output signal of the comparator and for receiving a control input for changes in the gain; a blow-off valve controlled by the control device for lowering fluid pressure downstream of the turbocompressor and means for generating a control input to the control device including means for receiving the measured value of the command variable and for generating a signal corresponding to the nonlinear compressor characteristics of a predetermined characteristic curve of the turbocompressor at the measured value of the command variable.

6. An apparatus according to claim 5, wherein: said reproduction means includes means for reproducing the blow-off curve.

7. A system for controlling a turbocompressor to avoid turbocompressor surge comprising: a first sensor to detect a turbocompressor variable to be used as a command variable; at least a second sensor to sense a second turbocompressor variable to be used as a controlled variable; function means for outputting preset parameters of a blow-off curve and for receiving the measured command variable and outputting a set controlled variable corresponding to the measured command variable based on the preset parameters for the blow-off curve; comparator means for receiving the actual value of the controlled variable and the set value of the controlled variable and outputting a signal representative of the difference between the measured controlled variable and set value of the controlled variable; control means for receiving the output signal of the comparator and for receiving a control input for changes in the gain; a blow-off valve controlled by the control device for lowering fluid pressure downstream of the turbocompressor and means for generating a control input to the control device including means for receiving the measured value of the command variable and for generating a signal corresponding to the nonlinear compressor characteristics of a predetermined characteristic curve of the turbocompressor at the measured value of the command variable, said control device being operated as recursive algorithm.

* * * * *